US009472137B2

(12) United States Patent
Ahn

(10) Patent No.: US 9,472,137 B2
(45) Date of Patent: Oct. 18, 2016

(54) ORGANIC LIGHT EMITTING DISPLAY DEVICE

(71) Applicant: Samsung Display Co., Ltd., Yongin, Gyeonggi-Do (KR)

(72) Inventor: Jeong-Keun Ahn, Yongin (KR)

(73) Assignee: Samsung Display Co., Ltd., Samsung-ro, Giheung-Gu, Yongin-si, Gyeonggi-do (KR)

( * ) Notice: Subject to any disclaimer, the term of this patent is extended or adjusted under 35 U.S.C. 154(b) by 358 days.

(21) Appl. No.: 13/940,060

(22) Filed: Jul. 11, 2013

(65) Prior Publication Data

US 2014/0239823 A1 Aug. 28, 2014

(30) Foreign Application Priority Data

Feb. 26, 2013 (KR) ..... 10-2013-0020458

(51) Int. Cl.
*G09G 3/36* (2006.01)
*G09G 3/32* (2016.01)

(52) U.S. Cl.
CPC .... *G09G 3/3233* (2013.01); *G09G 2300/0426* (2013.01); *G09G 2300/0842* (2013.01); *G09G 2330/02* (2013.01); *G09G 2360/16* (2013.01)

(58) Field of Classification Search
CPC ..... G09G 3/3208
USPC ..... 315/160–164, 169.3, 169.4; 345/76, 345/211–212
See application file for complete search history.

(56) References Cited

U.S. PATENT DOCUMENTS

| | | | | |
|---|---|---|---|---|
| 7,901,961 | B2 * | 3/2011 | Sung et al. | 438/22 |
| 8,004,480 | B2 * | 8/2011 | Kim | G09G 3/3291 345/76 |
| 8,847,246 | B2 * | 9/2014 | Ryu et al. | 257/88 |
| 8,933,626 | B2 * | 1/2015 | Choi et al. | 313/511 |
| 2005/0029937 | A1 | 2/2005 | Kim | |
| 2006/0044237 | A1 | 3/2006 | Lee et al. | |
| 2012/0292229 | A1 * | 11/2012 | Wieber et al. | 208/78 |

FOREIGN PATENT DOCUMENTS

| | | | |
|---|---|---|---|
| KR | 10-2005-0017695 | A | 2/2005 |
| KR | 10-2006-0018762 | A | 3/2006 |

* cited by examiner

*Primary Examiner* — Dinh Le
(74) *Attorney, Agent, or Firm* — Robert E. Bushnell, Esq.

(57) ABSTRACT

An organic light emitting display device includes a substrate including a display area on which a plurality of pixels are formed and a non-display area surrounding the display area; a first power line positioned on a lower non-display area; an auxiliary power line positioned on an upper non-display area; a first power supply supplying a first voltage to the first power line; and an auxiliary power supply supplying an auxiliary voltage to the auxiliary power line. Accordingly, it is possible to provide an organic light emitting display device capable of equalizing luminance by minimizing a variation in power supplied to each pixel.

14 Claims, 5 Drawing Sheets

ORGANIC LIGHT EMITTING DISPLAY DEVICE

RELATED APPLICATIONS

This application claims priority to and the benefit of Korean Patent Application No. 10-2013-0020458, filed on Feb. 26, 2013, in the Korean Intellectual Property Office, the entire content of which is incorporated herein by reference.

BACKGROUND OF THE INVENTION

1. Field of the Invention

An aspect of the present invention relates to an organic light emitting display device, and more particularly, to an organic light emitting display device capable of equalizing luminance by minimizing a variation in power supplied to each pixel.

2. Description of the Related Art

Recently, there have been developed various types of flat panel displays capable of reducing the weight and volume of cathode ray tubes, which are disadvantages. The flat panel displays include a liquid crystal display (LCD), a field emission display (FED), a plasma display panel (PDP), an organic light emitting display (OLED), and the like.

Among these flat panel displays, the OLED displays images using organic light emitting diodes that emit light through recombination of electrons and holes. The OLED has a fast response speed and is driven with low power consumption.

In this case, each pixel of the OLED emits light by the current supplied from a pixel power line to a light emitting element, thereby displaying an image.

However, the line resistance of the pixel power line is changed depending on the position of each pixel, and hence the degree of a voltage drop of power supplied to each pixel is also changed.

The amount of current is changed depending on the position of each pixel with respect to the same data signal due to unequal pixel power, and therefore, the entire luminance becomes unequal.

SUMMARY OF THE INVENTION

Embodiments provide an organic light emitting display device capable of equalizing luminance by minimizing a variation in power supplied to each pixel.

According to an aspect of the present invention, there is provided an organic light emitting display device, including: a substrate including a display area on which a plurality of pixels are formed and a non-display area surrounding the display area; a first power line positioned on a lower non-display area; an auxiliary power line positioned on an upper non-display area; a first power supply supplying a first voltage to the first power line; and an auxiliary power supply supplying an auxiliary voltage to the auxiliary power line.

The organic light emitting display device may further include a plurality of pixel power lines coupled between the first power line and the auxiliary power line.

The pixel power lines may be formed in a vertical direction from the first power line to the auxiliary power line.

The pixels may be coupled to the pixel power lines.

The auxiliary power line may be formed to extend from the upper non-display area to the lower non-display area through left and right non-display areas.

The coupling between the first power line and the first power supply and the coupling between the auxiliary power line and the auxiliary power supply may be performed on the lower non-display area.

The organic light emitting display device may further include a power comparator receiving the first voltage and the auxiliary voltage so as to compare the auxiliary voltage to the first voltage, and supplying a control signal representing a compared result to the auxiliary power supply.

The auxiliary power supply may control the auxiliary voltage, corresponding to the control signal supplied from the power comparator.

The auxiliary power supply may control the auxiliary voltage so that the first voltage and the auxiliary voltage, transmitted to the power comparator, are substantially identical to each other.

The first voltage transmitted to the power comparator may be transmitted from the first power supply or the first power line.

The auxiliary voltage transmitted to the power comparator may be transmitted from the auxiliary power line.

The auxiliary voltage transmitted to the power comparator may be transmitted from a central portion of the auxiliary power line positioned on the upper non-display area.

The organic light emitting display device may further include a first pixel power line coupled to the first power line; and a second pixel power line coupled to the auxiliary power line.

The first pixel power line may be formed to extend upward from the first power line towards the auxiliary power line, and may be coupled to a first group of the plurality of pixels.

The second pixel power line may be formed to extend downward from the auxiliary power line towards the first power line, and may be coupled to a second group of the plurality of pixels, which are not coupled to the first pixel power line.

The length of the first pixel power line may be longer than that of the second pixel power line.

The organic light emitting display device may further include a power controller calculating a target auxiliary voltage and transmitting the calculated target auxiliary voltage to the auxiliary power supply.

The auxiliary power supply may output an auxiliary voltage identical to the target auxiliary voltage calculated in the power controller.

Each of the first power supply and the auxiliary power supply may be implemented as a DC-DC converter.

As described above, according to the present invention, it is possible to provide an organic light emitting display device capable of equalizing luminance by minimizing a variation in power supplied to each pixel.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
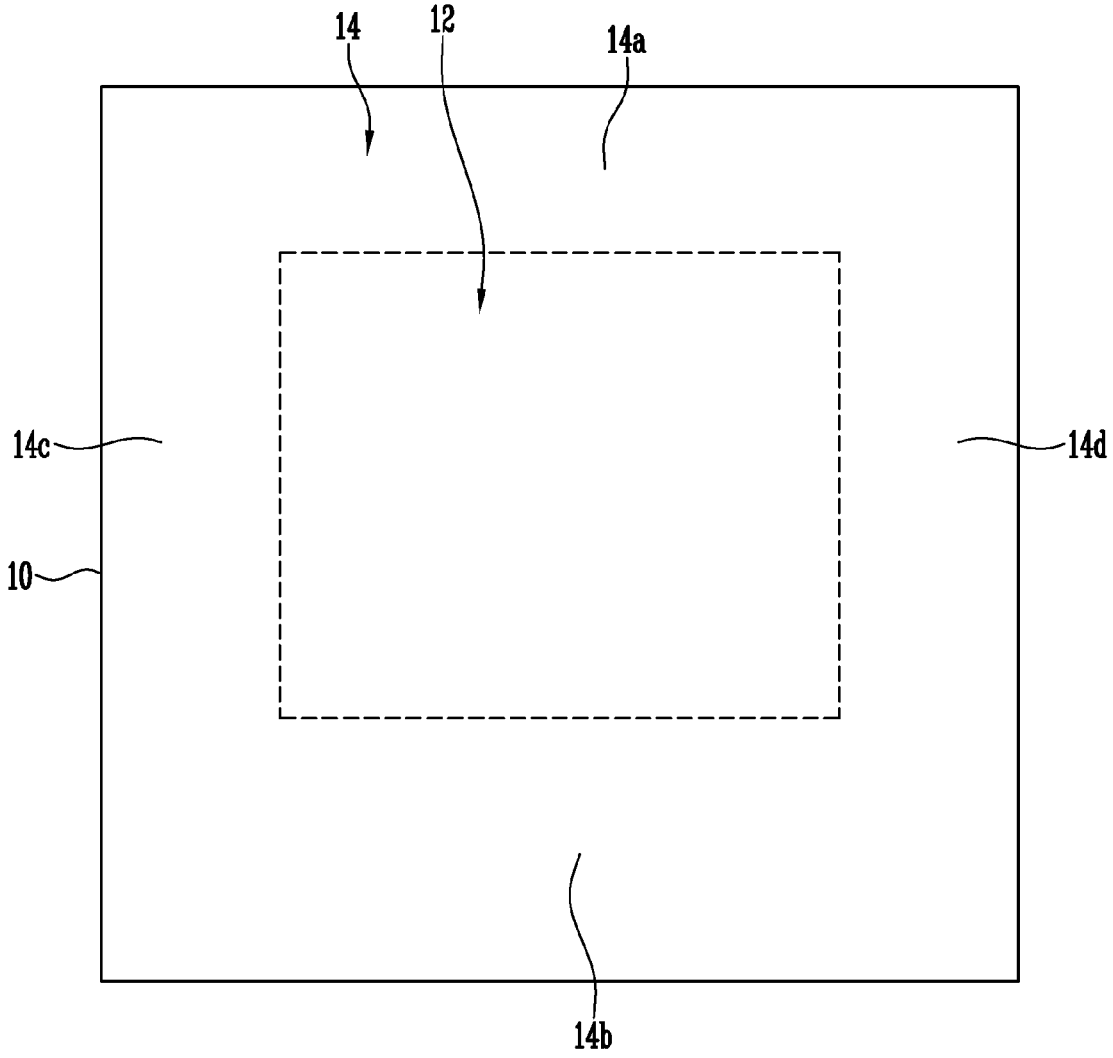
FIG. 1 is a view showing a display area and a non-display area according to an embodiment of the present invention.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

Figure 2:
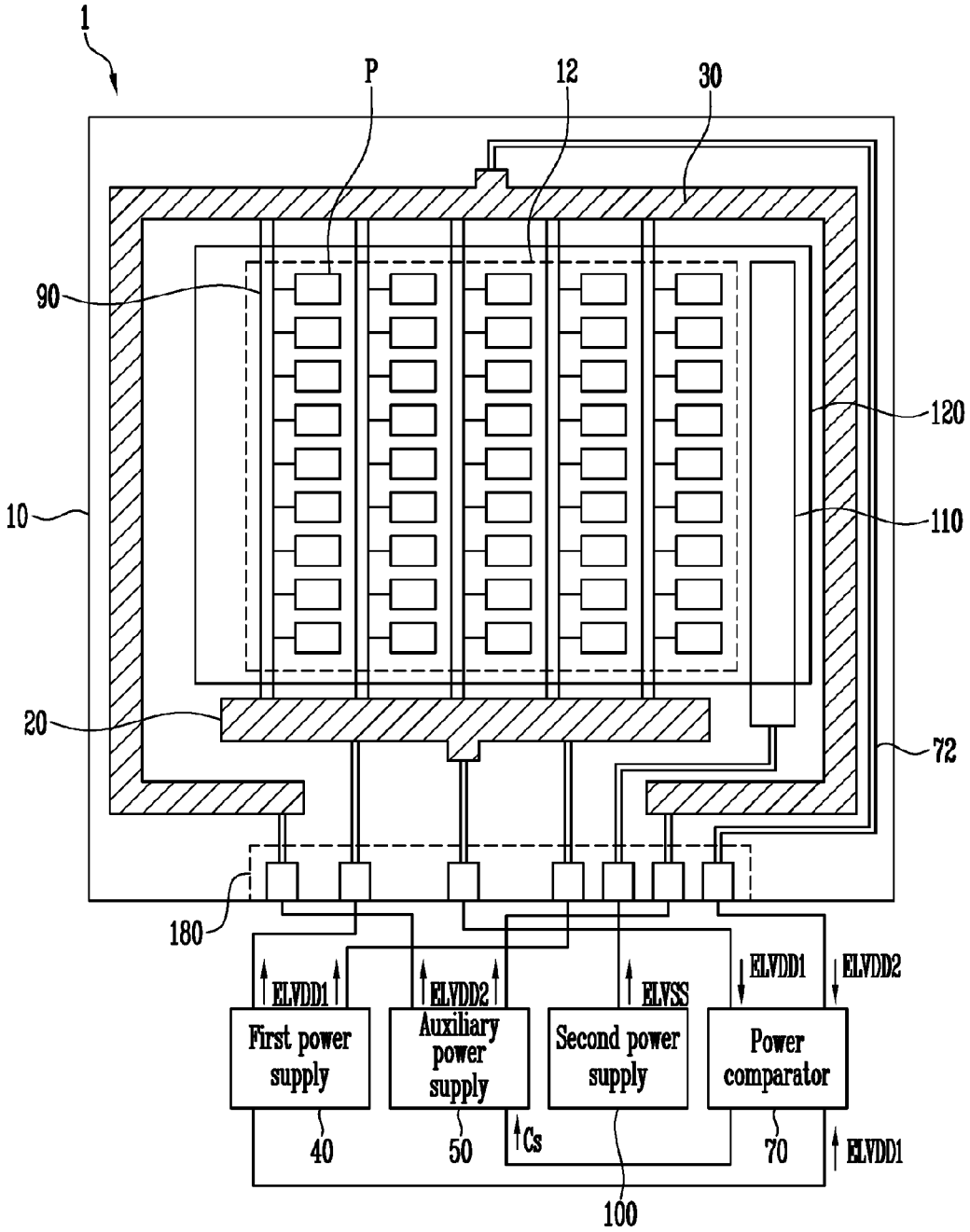
FIG. 2 is a view showing an organic light emitting display device according to the embodiment of the present invention.

FIG. 1 is a view showing a display area and a non-display area according to an embodiment of the present invention. FIG. 2 is a view showing an organic light emitting display device according to the embodiment of the present invention.

Referring to FIGS. 1 and 2, the organic light emitting display device 1 according to this embodiment may include a substrate 10, a first power line 20, an auxiliary power line 30, a first power supply 40 and an auxiliary power supply 50.

The substrate 10 may include a display area 12 and a non-display area 14. In this case, a plurality of pixels P for display an image may be positioned on the display area 12 of the substrate 10.

The non-display area 14 of the substrate 10 is positioned around the display area 12, and the first power line 20, the auxiliary power line 30 and the like may be positioned on the non-display area 14. For convenience of illustration, the non-display area 14 is divided into an upper non-display area 14*a*, a lower non-display area 14*b*, a left non-display area 14*c* and a right non-display area 14*d*.

In this case, the upper non-display area 14*a* may refer to a non-display area positioned at the upper side of the display area 12, and the lower non-display area 14*b* may refer to a non-display area positioned at the lower side of the display area 12. The left non-display area 14*c* may refer to a non-display area positioned at the left side of the display area 12, and the right non-display area may refer to a non-display area positioned at the right side of the display area 12.

Therefore, the display area 12 may be surrounded by the upper non-display area 14*a*, the lower non-display area 14*b*, the left non-display area 14*c* and the right non-display area 14*d*.

The first power line 20 may perform a function of transmitting a first voltage ELVDD1 supplied from the first power supply 40 to the pixels P. To this end, the first power line 20 may be positioned on the lower non-display area 14*b*.

The auxiliary power line 30 may perform a function of transmitting an auxiliary voltage ELVDD2 supplied from the auxiliary power supply 50 to the pixels P. In this case, to supply a voltage to the pixels P as uniformly as possible, the auxiliary power line 30 is preferably positioned in the opposite direction of the lower non-display area 14*b* on which the first power line 20 is positioned. In other words, the auxiliary power line may be positioned on the upper non-display area 14*a*.

The first power supply 40 may be electrically coupled to the first power line 20, so as to supply the first voltage ELVDD1 to the first power line 20. To this end, the first power supply 40 may be implemented as a DC-DC converter capable of generating the first voltage ELVDD1 by converting an external voltage.

The first power supply 40 may be coupled to the first power line 20 positioned on the lower non-display area 14*b*. In this case, the first power supply 40 may be coupled to the first power line 20 through a pad portion 180 positioned on the substrate 10. For example, the first power supply 40 may be coupled to the pad portion 180 in a state in which the first power supply 40 is mounted on a flexible printed circuit board (FPCB). Alternatively, the first power supply 40 may be mounted directly on the substrate 10 so as to be coupled to the first power line 20.

The auxiliary power supply 50 may be electrically coupled to the auxiliary power line 30, so as to supply the auxiliary voltage ELVDD2 to the auxiliary power line 30. To this end, the auxiliary power supply 50 may be implemented as a DC-DC converter capable of generating the auxiliary voltage ELVDD2 by converting an external voltage. In this case, the auxiliary power supply 50 is preferably coupled to the auxiliary power line 30 on the lower non-display area for convenience of processing.

This is because the coupling process between the first power supply 40 and the first power line 20 and the coupling process between the auxiliary power supply 50 and the auxiliary power line 30 can be simultaneously performed on the lower non-display area 14*b*.

To this end, the auxiliary power line 30, as shown in FIG. 2, is preferably formed to extend from the upper non-display area 14*a* to the lower non-display area 14*b* through the left and right non-display areas 14*c* and 14*d*. Therefore, the auxiliary power line 30 may be positioned to surround the display area 12.

The auxiliary power supply 50 may be coupled to the auxiliary power line 30 through the pad portion 180 positioned on the substrate 10. For example, the auxiliary power supply 50 may be coupled to the pad portion 180 in a state in which the auxiliary power supply 50 is mounted on the FPCB. Alternatively, the auxiliary power supply 50 may be mounted directly on the substrate 10 so as to be coupled to the auxiliary power line 30.

Referring to FIG. 2, a second power line 110 and a second power electrode 120, through which a second voltage ELVSS is transmitted to each pixel P, may be positioned on the substrate 10. For example, the second power line 110 may be formed on the non-display area 14, and the second power electrode 120 may be coupled between the second power line 110 and the pixels P.

A second power supply 100 may be electrically coupled to the second power line 110, so as to supply the second voltage ELVSS through the second power line 110. To this end, the second power supply 100 may be implemented as a DC-DC converter capable of generating the second voltage ELVSS by converting an external voltage.

The second power supply 100 may be coupled to the second power line 110 on the lower non-display area 14*b*. In this case, the second power supply 100 may be coupled to the second power line 110 through the pad portion 180 positioned on the substrate 10. For example, the second power supply 100 may be mounted directly on the substrate 10 so as to be coupled to the second power line 110.

A plurality of pixel power lines 90 may be coupled between the first power line 20 and the auxiliary power line 30 in order to transmit, to each pixel P, the voltages supplied from the first power line 20 and the auxiliary power line 30. The plurality of pixel power lines 90 may be positioned in the vertical direction so as to couple the auxiliary power line 30 positioned on the upper non-display area 14*a* to the first power line 20 positioned on the lower non-display area 14*b*. In this case, the pixels P may be electrically coupled to the pixel power lines 90, so as to receive a driving voltage ELVDD supplied from the pixel power lines 90.

Since the line resistance of the auxiliary power line 30 formed to extend from the lower non-display area 14*b* to the upper non-display area 14*a* is greater than that of the first power line 20, the amount of a voltage drop generated in the auxiliary power line 30 is greater than that of the first power line 20. Accordingly, although the amplitude of the first voltage ELVDD1 output from the first power supply 40 is set identical to that of the auxiliary power ELVDD2 output from the auxiliary power supply 50, the voltage of the first power line 20 positioned on the lower non-display area 14*b* is substantially different from that of the auxiliary power line 30 positioned on the upper non-display area 14*a*. Therefore, the power voltage different from a target voltage is applied to each pixel P, which causes the inequality of image quality and luminance.

In order to solve such a problem, the organic light emitting display device 1 according to this embodiment may further include a power comparator 70. The power comparator 70 may receive the first voltage ELVDD1 and the auxiliary voltage ELVDD2 so as to compare both the voltages, and supply a control signal Cs representing the compared result to the auxiliary power supply 50. That is, the power comparator 70 controls the auxiliary power supply 50, based on the difference between the fed-back first voltage ELVDD1 and auxiliary voltage ELVDD2, thereby preventing voltage inequality.

The control signal Cs may include information on the difference between the fed-back first voltage ELVDD1 and auxiliary voltage ELVDD2. In this case, the auxiliary power supply 50 may control the auxiliary voltage ELVDD2, corresponding to the control signal Cs supplied from the power comparator 70.

For example, in a case where it is decided by the control signal Cs that the first voltage ELVDD1 is higher than the auxiliary voltage ELVDD2, the auxiliary power supply 50 may increase the auxiliary voltage ELVDD2. In a case where it is decided by the control signal Cs that the first voltage ELVDD1 is lower than the auxiliary voltage ELVDD2, the auxiliary power supply 50 may decrease the auxiliary voltage ELVDD2. In a case where the difference between the first voltage ELVDD1 and the auxiliary voltage ELVDD2 is less than a reference value, the auxiliary power supply 50 does not change the amplitude of the auxiliary voltage ELVDD2 but may maintain the amplitude of the auxiliary voltage ELVDD2 as it is.

Accordingly, the auxiliary power supply 50 can control the auxiliary voltage ELVDD2 so that the first voltage ELVDD1 and the auxiliary voltage ELVDD2 are substantially identical to each other. In this case, the first voltage ELVDD1 input to the power comparator 70 may be supplied from the first power supply 40 or may be supplied from the first power line 20. Since the first power line 20 positioned on the lower non-display area 14*b* has a small amount of voltage drop, the output voltage of the first power supply 40 and the voltage of the first power line 20 may have a substantially small difference.

The auxiliary voltage ELVDD2 input to the power comparator 70 may be supplied from the auxiliary power line 30. For example, the voltage of the auxiliary power line 30 may be transmitted to the power comparator 70 through a feedback line 72 coupled between the auxiliary power line 30 and the power comparator 70. In this case, the feedback line 72 is preferably coupled to a central portion of the auxiliary power line 30 positioned on the upper non-display area 14*a* in order to transmit a more accurate voltage to the power comparator 70. Thus, the auxiliary voltage ELVDD2 input to the power comparator 70 can be transmitted from the central portion of the auxiliary power line 30 positioned on the upper non-display area 14*a*.

Figure 3:
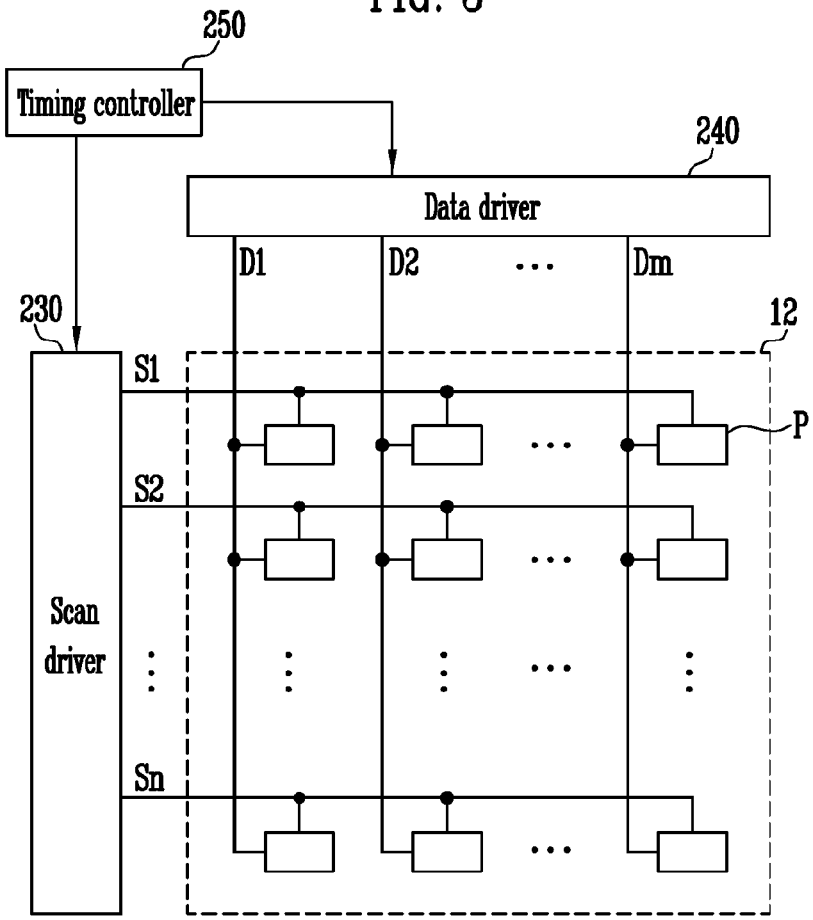
FIG. 3 is a block diagram showing pixels, a scan driver, a data driver and the like according to the embodiment of the present invention.

FIG. 3 is a block diagram showing pixels, a scan driver, a data driver and the like according to the embodiment of the present invention.

Referring to FIG. 3, the pixels P according to this embodiment may be coupled to scan lines S1 to Sn and data lines D1 to Dm in addition to the power lines. A scan driver 230 may generate a scan signal under the control of a timing controller 250 and supply the generated scan signal to the scan lines S1 to Sn. A data driver 230 may generate a data signal under the control of the timing controller 250 and supply the generated data signal to the data lines D1 to Dm. If the scan signal is sequentially supplied to the scan lines S1 to Sn, pixels P are sequentially selected for each line, and the selected pixels P receive the data signal supplied from the data lines D1 to Dm.

The timing controller 250 may perform a function of controlling the scan driver 230 and the data driver 240. The timing controller 250 may be integrally formed with at least one driver. In this case, the scan driver 230, the data driver 240 and the timing controller 250 may be mounted on the substrate 10, using a method known in the art, such as chip on glass (COG) or chip on film (COF).

Figure 4:
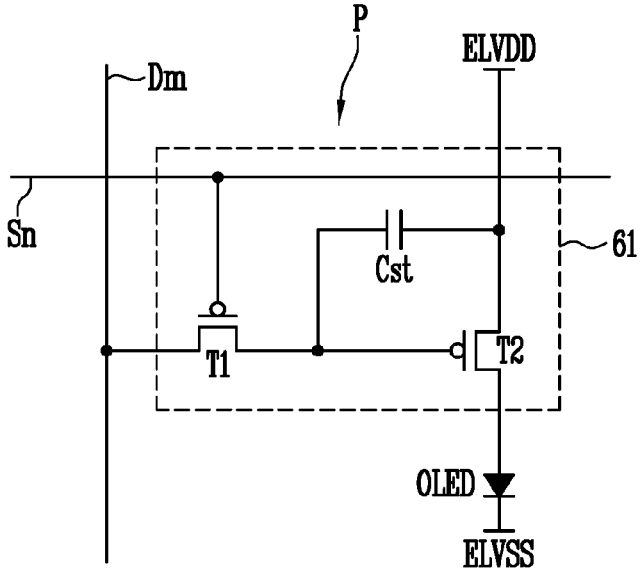
FIG. 4 is a circuit diagram showing a pixel according to the embodiment of the present invention.

FIG. 4 is a circuit diagram showing the pixel according to the embodiment of the present invention. Particularly, for convenience of illustration, a pixel coupled to an n-th scan line Sn and an m-th data line Dm is shown in FIG. 4.

Referring to FIG. 4, each pixel P includes an organic light emitting diode OLED, and a pixel circuit 61 coupled to the data line Dm and the scan line Sn so as to control the organic light emitting diode OLED. An anode electrode of the organic light emitting diode OLED is coupled to the pixel circuit 61, and a cathode electrode of the organic light emitting diode OLED is coupled to a second voltage ELVSS.

The organic light emitting diode OLED generates light with a predetermined luminance corresponding to current supplied from the pixel circuit 61.

The pixel circuit 61 controls the amount of current supplied to the organic light emitting diode OLED, corresponding to a data signal supplied to the data line Dm when a scan signal is supplied to the scan line Sn. To this end, the pixel circuit 61 includes a second transistor T2 coupled between a driving voltage ELVDD and the organic light emitting diode OLED, a first transistor T1 coupled among the second transistor T2, the data line Dm and the scan line Sn, and a storage capacitor Cst coupled between a gate electrode and a first electrode of the second transistor T2. A gate electrode of the first transistor T1 is coupled to the scan line Sn, and a first electrode of the first transistor T1 is coupled to the data line Dm. A second electrode of the first transistor T1 is coupled to one terminal of the storage capacitor Cst.

Here, the first electrode is set as any one of source and drain electrodes, and the second electrode is set as an electrode different from the first electrode. For example, if the first electrode is set as the source electrode, the second electrode is set as the drain electrode. When the scan signal is supplied from the scan line Sn, the first transistor T1 coupled to the scan line Sn and the data line Dm is turned on to supply the data signal supplied from the data line Dm to the storage capacitor Cst. In this case, the storage capacitor Cst charges a voltage corresponding to the data signal.

The gate electrode of the second transistor T2 is coupled to the one terminal of the storage capacitor Cst, and the first electrode of the second transistor T2 is coupled to the other terminal of the storage capacitor Cst and the driving voltage ELVDD. A second electrode of the second transistor T2 is coupled to the anode electrode of the organic light emitting diode OLED. The second transistor T2 controls the amount of current flowing from the driving voltage ELVDD to the second voltage ELVSS via the organic light emitting diode OLED, corresponding to the voltage stored in the storage capacitor Cst. In this case, the organic light emitting diode OLED generates light corresponding to the amount of current supplied from the second transistor T2.

Here, the second voltage ELVSS may be supplied to each pixel P through the second power line 110 and the second power electrode 120. The driving voltage ELVDD refers to a voltage supplied from pixel power lines 90 (FIG. 2), 91 and 92 (FIG. 5) to the pixels P.

The structure of the pixel shown in FIG. 4 described above is merely one embodiment of the present invention, and therefore, the pixel P of the present invention is not limited to the structure of the pixel. Practically, the pixel circuit 61 has the structure of a circuit capable of supplying current to the organic light emitting diode OLED, and may be selected as any one of various structures currently known in the art.

Figure 5:
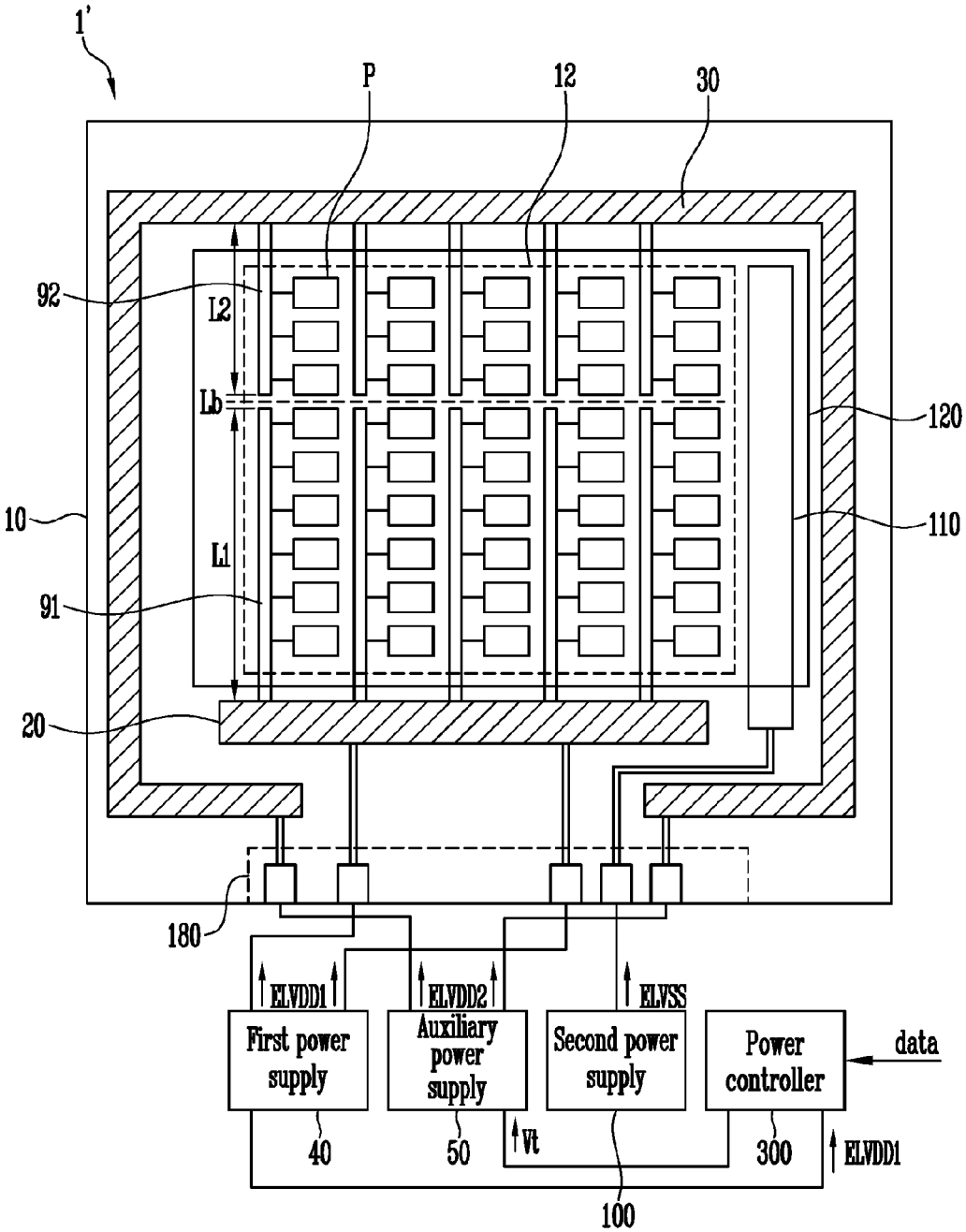
FIG. 5 is a view showing an organic light emitting display device according to another embodiment of the present invention.

FIG. 5 is a view showing an organic light emitting display device according to another embodiment of the present invention. Particularly, in this embodiment, descriptions of components overlapping with those of the aforementioned embodiment will be omitted, and components different from those of the aforementioned embodiment will be mainly described.

Referring to FIG. 5, the organic light emitting display device 1' according to this embodiment includes first and second pixel power lines 91 and 92 separated from each other. That is, in the embodiment of FIG. 2, one pixel power line 90 is coupled between the first power line 20 and the auxiliary power line 30, but in the embodiment shown in FIG. 5, the pixel power line 90 is divided into two power lines, i.e., first and second pixel power lines 91 and 92.

The first pixel power line 91 may be coupled to the first power line 20, so as to transmit a first voltage ELVDD1 from the first power line 20 to some pixels (first group of pixels). The second pixel power line 92 may be coupled to the auxiliary power line 30, so as to transmit an auxiliary voltage ELVDD2 from the auxiliary power line 30 to some other pixels (second group of pixels). In this case, each pixel P may use the first voltage ELVDD1 or the auxiliary voltage ELVDD2 as a driving voltage ELVDD.

For example, the first pixel power line 91 is formed to extend toward the upper direction from the first power line 20 positioned on the lower non-display area 14*b*, and may be coupled to some of the whole pixels. The second pixel power line 92 is formed to extend toward the lower direction from the auxiliary power line 30 positioned on the upper non-display area 14*a*, and may be coupled to the others of the whole pixels, which are not coupled to the first pixel power line 91.

In this case, a lateral line may be viewed at a boundary Lb between the first and second pixel power lines 91 and 92. The lateral line may occur when the power voltage supplied to pixels adjacent to the upper side of the boundary Lb is different from that supplied to pixels adjacent to the lower side of the boundary Lb.

In order to solve such a problem, the length L1 of the first pixel power line 91 is preferably formed longer than that L2 of the second pixel power line 92. Accordingly, the length of the line from the auxiliary power supply 50 to the pixel adjacent to the upper side of the boundary Lb and the length of the line from the first power supply 40 to the pixel adjacent to the lower side of the boundary Lb can be formed as similar to each other as possible, so that it is possible to minimize the difference in power voltage between the pixels respectively adjacent to both sides of the boundary Lb.

Referring to FIG. 5, the organic light emitting display device 1' according to this embodiment may further include a power controller 300. The power controller 300 may calculates a target auxiliary voltage Vt and transmit the target auxiliary voltage Vt to the power supply 50. In this case, the auxiliary power supply 50 may control the auxiliary voltage ELVDD2 identical to the transmitted target auxiliary voltage Vt and output the controlled auxiliary voltage ELVDD2.

For example, the power controller 300 may calculate the target auxiliary voltage Vt, using a data signal data1 supplied to each pixel coupled to the first pixel power line 91 and a data signal data2 supplied to each pixel coupled to the second pixel power line 92.

Figure 6:
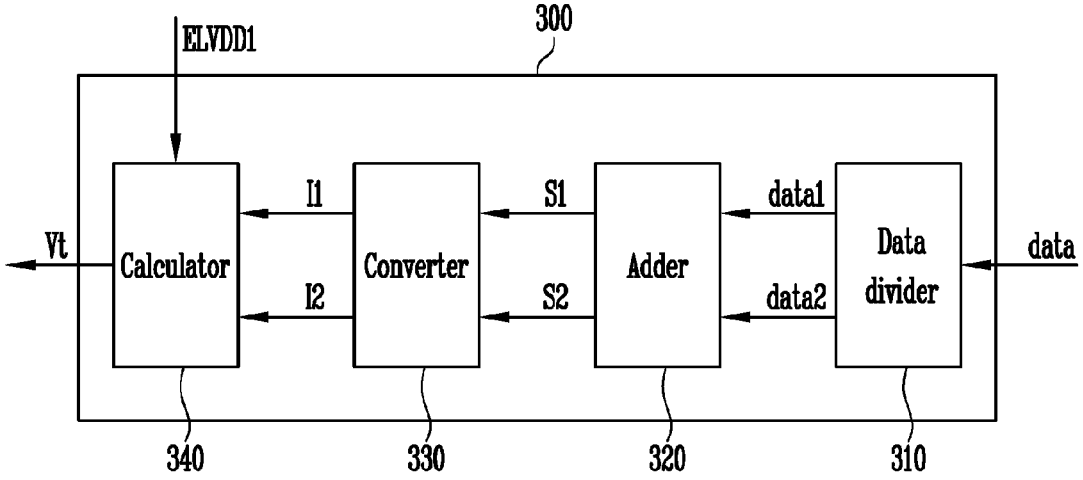
FIG. 6 is a block diagram showing a power controller shown in FIG. 5.

FIG. 6 is a block diagram showing the power controller shown in FIG. 5. Referring to FIG. 6, the power controller 300 according to this embodiment may include a data divider 310, an adder 320, a converter 330 and a calculator 340.

The data divider 310 performs a function of dividing a data signal data transmitted from the outside of the power controller 300 into a first data signal data 1 supplied to each pixel coupled to the first pixel power line 91 and a second data signal data2 supplied to each pixel coupled to the second pixel power line 92. That is, the data divider 310 may divide the data signal data into the first data signal data1 supplied to each pixel positioned at the lower side of the boundary Lb and the second data signal data2 supplied to each pixel positioned at the upper side of the boundary Lb, based on FIG. 5. In this case, the data signal data may be supplied from the timing controller 250.

The adder 320 may calculates a sum S1 of the first data signals data 1 supplied to the respective pixels coupled to the first pixel power line 91, and calculate a sum S2 of the second data signals data2 supplied to the respective pixels coupled to the second pixel power line 92.

The converter 330 may convert the sum S1 of the first data signals data1 into a first current value I1 corresponding thereto, and convert the sum S2 of the second data signals data2 into a second current value I2 corresponding thereto. In this case, the converter 330 may determine a current value corresponding to the sum of data signals with reference to a look-up table or the like.

The calculator 340 may calculate a target auxiliary voltage Vt, using the first and second current values I1 and 12 calculated from the converter 330. For example, the calculator 340 may calculate the target auxiliary voltage Vt through the following equation.

$$Vt=ELVDD1-C*I1+(A+B)*I2 \quad (A,B \text{ and } C \text{ are constants})$$

In this case, the constant A may be determined, based on the resistance of the line from the auxiliary power supply 50 to the auxiliary power line 30 positioned on the upper non-display area 14*a*, and the constant B may be determined, based on the resistance of the line from the auxiliary power line 30 positioned on the upper non-display area 14*a* to the second pixel power line 92. The constant C may be determined, based on the resistance of the line from the first power supply 40 to the first pixel power line 91. The first voltage ELVDD1 required in the calculating process of the target auxiliary voltage Vt may be transmitted from the first power supply 40.

The calculator 340 may transmit the target auxiliary voltage Vt calculated through the process to the auxiliary power supply 50.

Accordingly, the auxiliary power supply 50 receiving the target auxiliary voltage Vt transmitted from the calculator 340 can adjust the amplitude of the output auxiliary voltage ELVDD2 identically to that of the target auxiliary voltage Vt and output the auxiliary voltage ELVDD2.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display device, comprising:

a substrate including a display area on which a plurality of pixels are formed and a non-display area surrounding the display area;

a first power line disposed on the non-display area of the substrate;

an auxiliary power line disposed on the non-display area of the substrate, the auxiliary power line being separated from the first power line;

a first power supply supplying a first voltage to the first power line;

an auxiliary power supply supplying an auxiliary voltage to the auxiliary power line;

a plurality of pixel power lines directly connecting the auxiliary power line to the first power line, the pixel power lines coupled to the pixels and supplying a driving voltage to the pixels; and a power comparator comparing the auxiliary voltage to the first voltage, the power comparator supplying a control signal representing a compared result to the auxiliary power supply.

2. The organic light emitting display device of claim 1, wherein the first power line is formed on a side of the non-display area, and the auxiliary power line is formed on another side of the non-display area, said another side being an opposite side of the side of the non-display area.

3. The organic light emitting display device of claim 2, wherein the first power supply and the auxiliary power supply are disposed closer to the side of the non-display area than said another side of the non-display area.

4. The organic light emitting display device of claim 1, wherein the auxiliary power supply controls the auxiliary voltage based on the control signal supplied from the power comparator.

5. The organic light emitting display device of claim 4, wherein the auxiliary power supply controls the auxiliary voltage to set the auxiliary power voltage to be substantially identical to the first voltage.

6. The organic light emitting display device of claim 1, wherein the power comparator is coupled to the first power supply or to the first power line to detect the first voltage.

7. The organic light emitting display device of claim 1, wherein the power comparator is coupled to the auxiliary power line to detect the auxiliary voltage.

8. The organic light emitting display device of claim 1, further comprising a feedback line disposed on the substrate, the feedback line connecting the power comparator to the auxiliary power line.

9. The organic light emitting display device of claim 1, wherein the first power supply is implemented as a DC-DC converter generating the first voltage by converting an external voltage, and the auxiliary power supply is implemented as a DC-DC converter generating the auxiliary voltage by converting an external voltage.

10. An organic light emitting display device, comprising:

a substrate including a display area on which a plurality of pixels are formed and a non-display area surrounding the display area;

a first power line positioned on a side of the non-display area;

an auxiliary power line positioned on another side of the non-display area;

a first power supply supplying a first voltage to the first power line;

an auxiliary power supply supplying an auxiliary voltage to the auxiliary power line;

a first pixel power line coupled to the first power line, a first group of the pixels being coupled to the first pixel power line;

a second pixel power line coupled to the auxiliary power line, a second group of the pixels being coupled to the second pixel power line; and a power controller calculating a target auxiliary voltage based on a data signal supplied to the first group of the pixels and based on a data signal supplied to the second group of the pixels, the power controller transmitting the calculated target auxiliary voltage to the auxiliary power supply.

11. The organic light emitting display device of claim 10, wherein the first pixel power line is formed to extend from the first power line towards the auxiliary power line.

12. The organic light emitting display device of claim 11, wherein the second pixel power line is formed to extend from the auxiliary power line towards the first power line.

13. The organic light emitting display device of claim 12, wherein the length of the first pixel power line is longer than that of the second pixel power line.

14. The organic light emitting display device of claim 10, wherein the auxiliary power supply outputs the auxiliary voltage identical to the target auxiliary voltage calculated in the power controller.

* * * * *